US006721993B1

(12) United States Patent
Jensen et al.

(10) Patent No.: US 6,721,993 B1
(45) Date of Patent: Apr. 20, 2004

(54) HINGE ASSEMBLY FOR AIR HANDLING SYSTEM

(75) Inventors: Brock Jensen, Tullahoma, TN (US); Michael W. Austin, McMinnville, TN (US); Christian C. Herbeck, Manchester, TN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/278,356

(22) Filed: Oct. 23, 2002

(51) Int. Cl.[7] ..... E05D 5/02

(52) U.S. Cl. ..... 16/252; 16/253; 16/264; 16/DIG. 43; 411/340; 411/345; 296/256.75; 296/251; 296/256.71

(58) Field of Search ..... 16/252, 231, 253, 16/254, 259, 261, 264, DIG. 43; 411/340, 344, 345, 346; 244/131, 132; 292/256.73, 251, 256.75, 256.71

(56) References Cited

U.S. PATENT DOCUMENTS 3,601,867 A * 8/1971 Turner ..... 24/278
5,044,854 A * 9/1991 Oh ..... 411/344
6,070,295 A * 6/2000 Hulsebus ..... 16/254
6,199,798 B1 * 3/2001 Stephan et al. ..... 244/129.4
6,381,762 B1 * 5/2002 Moser ..... 4/240

* cited by examiner

*Primary Examiner*—Gary Estremsky
*Assistant Examiner*—Mark Williams
(74) *Attorney, Agent, or Firm*—Wall Marjama & Bilinski LLP

(57) ABSTRACT

A high strength easily assembled hinge assembly for supporting an access door upon a modular section of an air handling system. The assembly includes a pair of spaced apart mounting flanges that are connected by an arm. One end of the arm is pivotably mounted in a first end flange and integrally mounted on the second flange. The first mounting flange is locked to the framework of the modular section using a special clamp that acts in conjunction with a locating frame that registers the assembly in a home position. The second mounting flange is secured to the door using a pair of mounting screws.

9 Claims, 3 Drawing Sheets

HINGE ASSEMBLY FOR AIR HANDLING SYSTEM

FIELD OF THE INVENTION

This invention relates to an air handling system and in particular to a hinge assembly for use in an air handling system.

BACKGROUND OF THE INVENTION

In one type of modular air handling system manufactured by Carrier Corporation of Syracuse, N.Y., each modular section includes a pair of rectangular end frames that are cojoined at the corners by elongated beams to create a three dimensional framework. The side openings of the framework are closed by panels made of sheet metal and cored with a foam material having a higher value. Access door panels are placed in some of the modular sections to provide easy access to equipment that is housed within the particular section. Heretofore, the doors were attached to the framework using living hinges. Although this living hinge arrangement works well in practice, assembling the hinge is rather difficult and time consuming. In addition, if the hinge becomes damaged, the entire door often times must be replaced which can prove to be costly. Efforts to replace the living hinge with a more conventional metal hinge have meet with limited success due to the fact that the hinge cannot be effectively fastened to the sheet metal of a panel door.

SUMMARY OF THE INVENTION

It is therefore an object of the present invention to improve modular air handling systems having modular sections.

It is a further object of the present invention to provide an improved hinge assembly for mounting an access door to the framework of a modular section of an air handling system.

A still further object of the present invention is to provide a high strength door hinge assembly which can be easily installed in an air handling system within a short period of time.

Another object of the invention is to provide a high strength hinge assembly that can be secured to a sheet metal access door without damaging the door.

These and other objects of the present invention are attained by a hinge assembly for rotatably supporting a sheet metal door in the framework of a modular section of an air handling system. The modular section contains a square tubular support column that has a rectangular shaped hole passing through one outer wall of the column. The hinge assembly includes a pair of spaced apart mounting flanges that are connected by an arm. The arm is rotatably coupled to a first mounting flange by a hinge pin and integrally joined to the second mounting flange. A locating frame is located upon the bottom surface of the first mounting flange which can be received within the hole in the column to locate the hinge assembly in an operative or home position wherein the second mounting flange is located over the outer surface of the door. A guide post is supported in the locating frame that extends downwardly from the frame and a clamp is slidably contained upon the guide pin. A threaded member passes through the locating frame and is arranged to engage the clamp. The clamp has a shape that complements that of the hole in the column such that the clamp can be passed through the hole and turned 90° to align the locating frame with the hole. The threaded member is used to draw the clamp into locking engagement against the inside wall of the column wall thus registering the locating frame within the hole. The second mounting flange is secured to the face panel of the door using a pair of screws that are arranged to engage AVK type nuts mounted inside the door behind its front panel.

BRIEF DESCRIPTION OF THE DRAWINGS

For a further understanding of these and objects of the present invention, reference will be made to the following detailed description of the invention which is to be read in association with the accompanying drawing, wherein.

DETAILED DESCRIPTION OF THE INVENTION

Figure 1:
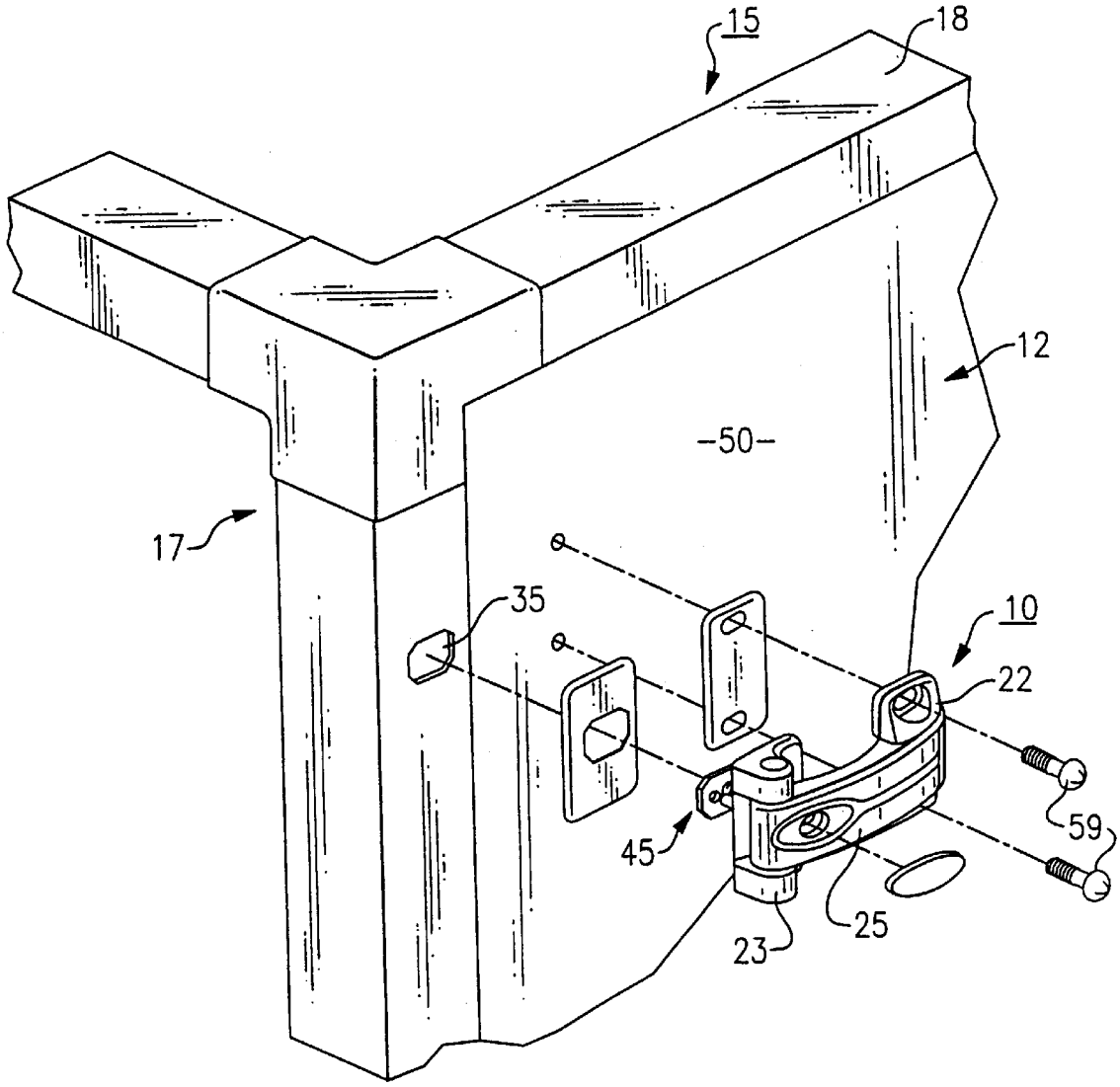
FIG. 1 is a partial exploded view in perspective showing the hinge assembly of the present invention and a modular section of an air handling system.
Figure 2:
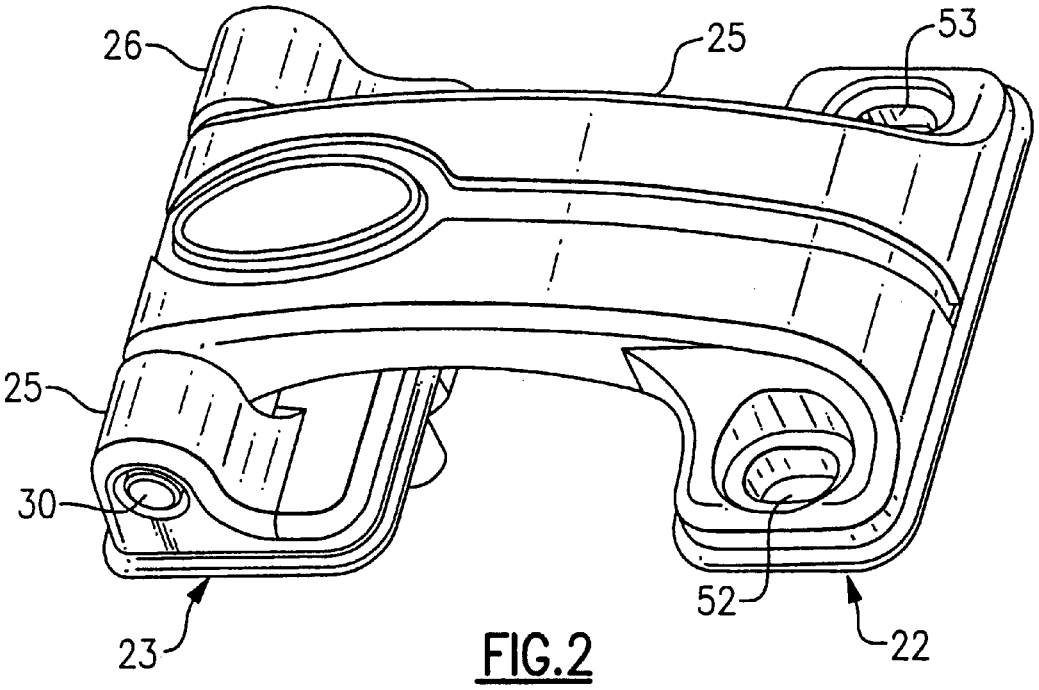
FIG. 2 is an enlarged top perspective view of the hinge assembly.

Turning initially to FIG. 1, there is shown a hinge assembly that is generally referenced 10 that is ideally suited for rotatably supporting a door 12 to a modular section of an air handling system 15. The framework of the modular section includes a pair of spaced apart end frames 17, a portion of which is shown in FIG. 1. The two end frames are cojoined at the corners by elongated beams 18 to provide an open sided framework for the modular section. Typically, the side openings in the framework are closed by insulated side panel using special fasteners. In many applications, entry to a modular section is needed in order to gain access to equipment housed within the section. To this end the door 12 is supported by at least two hinge assemblies in the framework of the modular section so that the door can swing from the illustrated closed position to a fully opened position.

Turning now to FIGS. 2–5, each hinge assembly 10 includes a pair of spaced apart base flanges 22 and 23. Base flange 22 is integrally joined to one end of an elongated arm 25. The opposite end of the arm is, in turn, hinged to the other base flange 23. A pair of trunnions 25 and 26 are located upon base flange 23 or either side of the arm. A shaft 30 is seated in the trunnions which passes through a hole 31 (FIG. 3) that passes through the end section of the arm. Accordingly, the end flange 22 and arm 25 can swing as a unit about the shaft 30.

Figure 3:
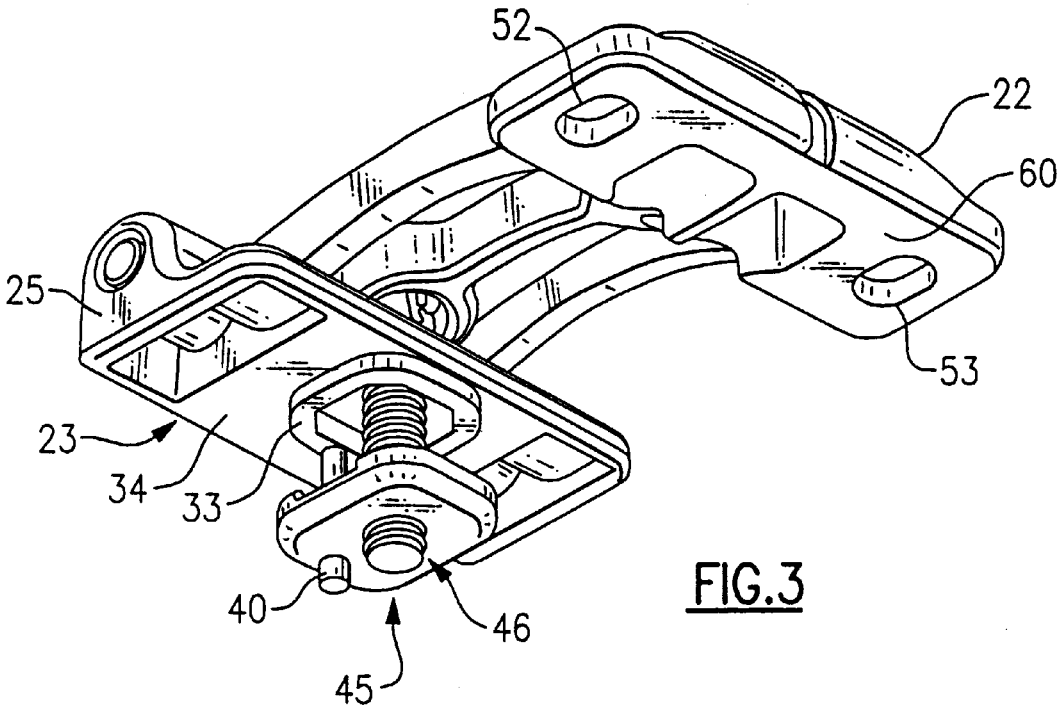
FIG. 3 is an enlarge bottom perspective view of the hinge assembly.

As shown in FIG. 3, a locating frame 33 is mounted in the bottom wall of the mounting flange 23. The locating frame complements the shape of a hinge receiving hole 35 (FIG. 1) that passes through the side wall of column 36 that forms part of one of the modular units end frames 17. The locating frame is capable of being retained within the hole in the column to locate the hinge unit in a desired home position wherein the arm and the opposing base flange 23 extends over the front face of the door when the door is flush mounted in the framework of the modular section. When the frame is so registered in the column the shaft of the hinge unit will be in parallel alignment with the side edge 38 of the door.

A cylindrical guide pin 40 is staked into the rim of the locating frame. The pin extends downwardly from the bottom surface of the frame and is generally aligned perpendicular to the shaft 30 of the hinge unit. A clamp 45 is slidably contained upon the guide pin so that the clamp can move towards and away from the locating frame. A bolt 46 is passed through a suitable hole formed in the center of the locating frame and is threaded into the clamp so that the clamp is moved either toward or away from the locating frame as the bolt is turned. The clamp is shown in a raised unlocked position in FIG. 4. FIG. 5 shows the clamp drawn down tightly against the interior wall surface of the column.

Figure 4:
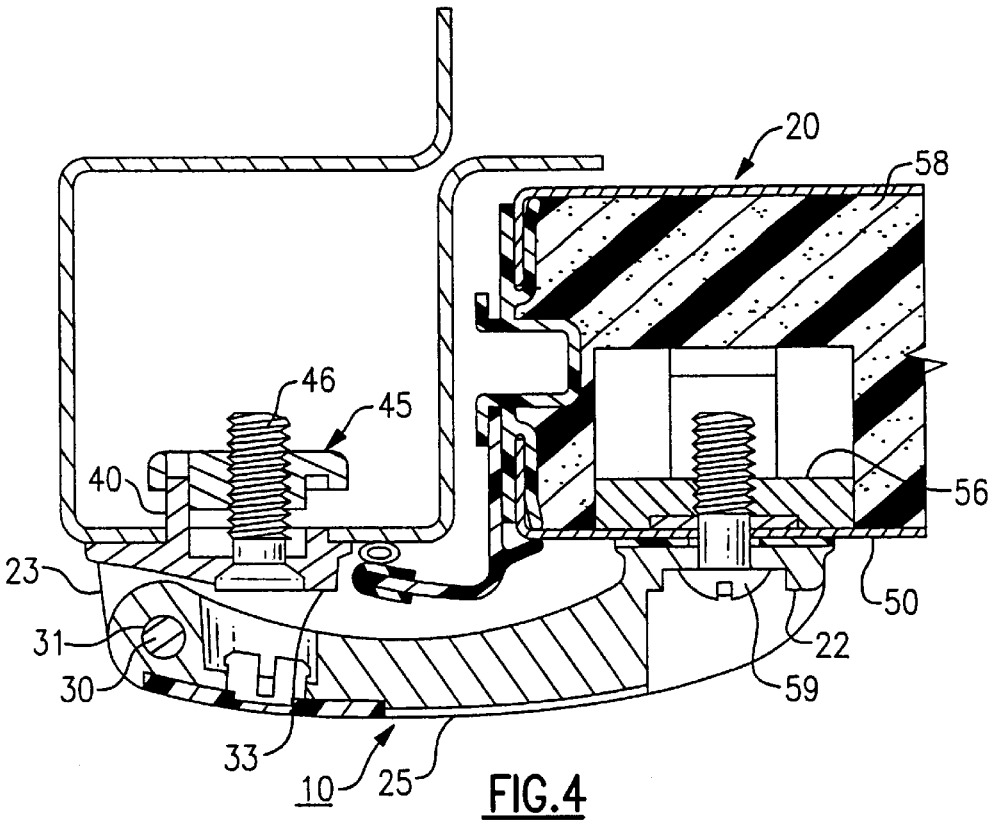
FIG. 4 is a side elevation in section illustrating the clamp of the hinge assembly in an unlocked condition.
Figure 5:
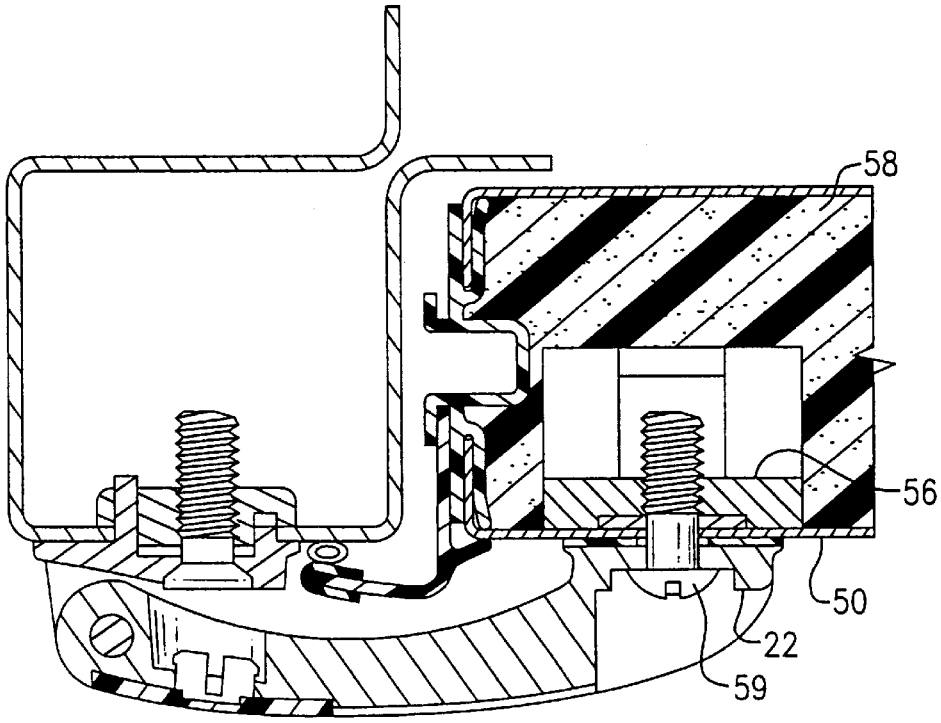
FIG. 5 is a view similar to FIG. 4 illustrating the clamp in a locked condition.

As best illustrated in FIGS. 4 and 5, the door 20 is constructed of sheet metal parts that includes a front panel 50. The interior of the door is basically hollow and is filled with a foam core material having a higher value. In assembly, the flange 22 of the hinge unit is seated against the outer face of the front panel. The end flange, in turn, is provided with elongated clearance holes 52 and 53 located on either side of the arm 25. The holes in the end flange are coaxially aligned with a pair of holes 54 and 55 in the front panel of the door. A nut 56, that is sometimes referred to as an AVK nut, is mounted on the back side of the front panel and is also in axial alignment with the holes 54 and 55. The nut is encapsulated within the foam core 58 of the door. Screw 59 is passed through the holes in the end flange and the door panel and threadably engages one of the nuts. The screws are tightened down to draw the end flange 22 against the front panel of the door. As illustrated in FIG. 3, the flat bottom surface 60 of the flange 22 provides a large surface area so that the forces generated by the screws are widely distributed over the surface of the door panel thus preventing the relatively weak panel from being damaged. The clearance holes 52 and 53 in the end flange are elongated along the longitudinal axis of the hinge unit to provide ample clearance to adjust the position of the hinge during assembly.

In practice, the two end flanges and the hinge unit can be cast from a suitable metal or high strength plastic to provide an extremely strong and durable hinge assembly. It should be also noted that the hinge assembly contains a minimum number of components and can be mounted upon the modular section in a relatively short period of time using a small number of simple, relatively available, tools.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A hinge assembly for supporting a door upon a framework of an air handling system, said assembly further including:

a tubular column that forms part of the framework, said column having a rectangular hole in one wall thereof;

a hinge unit having a first mounting flange and a spaced apart second mounting flange that are cojoined by an arm;

a hinge for rotatably joining said arm to said first mounting flange;

a locating frame mounted on a bottom wall of said first mounting flange that can be slidably received within said hole formed in said column to locate the hinge unit in a home position wherein the second mounting flange extending over the outside face of the door;

a guide pin mounted in said locating frame that extends downwardly from said frame;

a clamp slidably mounted upon said guide pin, said clamp having a shape that compliments the shape of said hole in said column such that said clamp can be passed through the hole and turned 90° to place the hinge unit in said home position;

a member having a threaded shank that passes through said locating frame and engages said clamp whereby said clamp is drawn into locking engagement against said column when said threaded shank is turned in a first direction; and means to secure the second mounting flange to the door.

2. The assembly of claim 1 wherein said hinge includes a pair of spaced apart trunnions located upon said first mounting flange on either side of said arm and a shaft supported in said trunnions that passes through said arm.

3. The assembly of claim 2 wherein said shaft is parallel with one side edge of said door when the hinge unit is in said home position.

4. The assembly of claim 3 wherein said guide pin is perpendicularly aligned with said shaft.

5. The assembly of claim I wherein said second mounting flange has a pair of spaced apart slotted hole formed therein and said means to secure said second flange to said door are screws that pass through said slotted holes and which threadably engage said door.

6. The assembly of claim 5 wherein said screws are arranged to engage nuts mounted behind a front panel of said door.

7. The assembly of claim 1 wherein said second mounting flange is integrally joined to said arm.

8. The assembly of claim 1 wherein said mounting flanges and said arm are fabricated of metal.

9. The assembly of claim 1 wherein said mounting flanges and said arm are fabricated of a high strength plastic.

* * * * *